US011083282B1

(12) United States Patent
Liu

(10) Patent No.: US 11,083,282 B1
(45) Date of Patent: Aug. 10, 2021

(54) HEIGHT-ADJUSTABLE DESK STRUCTURE

(71) Applicant: C.D. Great Furniture Co., Ltd., Taichung (TW)

(72) Inventor: Tseng-Lang Liu, Taichung (TW)

(73) Assignee: C.D. Great Furniture Co., Ltd., Taichung (TW)

( * ) Notice: Subject to any disclaimer, the term of this patent is extended or adjusted under 35 U.S.C. 154(b) by 0 days.

(21) Appl. No.: 16/871,715

(22) Filed: May 11, 2020

(51) Int. Cl.
*A47B 9/16* (2006.01)
*A47B 21/02* (2006.01)

(52) U.S. Cl.
CPC ..... *A47B 9/16* (2013.01); *A47B 21/02* (2013.01)

(58) Field of Classification Search
CPC ..... A47B 9/16; A47B 21/02
USPC ..... 108/145; 248/421, 588, 122
See application file for complete search history.

(56) References Cited

U.S. PATENT DOCUMENTS 383,610 A * 5/1888 Bell et al. ..... B62B 3/0625 254/10 C
4,640,488 A * 2/1987 Sakamoto ..... B60N 2/502 108/145
5,211,369 A * 5/1993 Hoerner ..... B60N 2/502 248/588
7,246,784 B1 * 7/2007 Lopez ..... A47B 51/00 108/145
7,637,468 B2 * 12/2009 Huang ..... A47B 23/043 108/145
7,677,518 B2 * 3/2010 Chouinard ..... A47B 21/02 248/370
8,439,334 B2 * 5/2013 Deml ..... F16F 15/04 267/140.11
8,844,894 B2 * 9/2014 Archambault ..... B60N 2/508 248/588
9,326,598 B1 * 5/2016 West ..... A47B 3/02
10,092,089 B1 * 10/2018 Yuan ..... A47B 3/002
2007/0295882 A1 * 12/2007 Catton ..... B60N 2/508 248/588
2013/0145972 A1 * 6/2013 Knox ..... B60N 2/24 108/145
2014/0264215 A1 * 9/2014 Yustus ..... B66F 17/00 254/93 R (Continued)

FOREIGN PATENT DOCUMENTS

CA 2925376 A1 * 10/2016 ..... A47B 3/02
DE 202016106868 U1 * 12/2016 ..... A47B 9/02

(Continued)

*Primary Examiner* — Jose V Chen
(74) *Attorney, Agent, or Firm* — Wang Law Firm, Inc.

(57) ABSTRACT

A height-adjustable desk structure includes a desktop, two adjustment members, two linkage sets, two positioning members, two sliding sets, two springs and two supporting stands, and the adjustment members penetrate the top surface of the desktop and can be viewed by the user directly. When the two adjustment members are actuated, the moving members move from a locked position to a released position in order to allow the two supporting stands to swing freely. When the two adjustment members are released, the moving members move from the released position to the locked position and then, is positioned inside the positioning recesses. Accordingly, the user is able to clearly see the locations of the adjustment members of the desk, thereby enabling easy and intuitive use and ensuring safety.

4 Claims, 10 Drawing Sheets

(56) References Cited

U.S. PATENT DOCUMENTS

| | | | | |
|---|---|---|---|---|
| 2015/0014609 | A1* | 1/2015 | Mohr | B66F 7/065 254/122 |
| 2016/0249737 | A1* | 9/2016 | Han | A47B 9/14 108/145 |
| 2018/0008037 | A1* | 1/2018 | Laudadio | A47B 9/16 |
| 2018/0146775 | A1* | 5/2018 | You | A47B 9/16 |
| 2018/0177289 | A1* | 6/2018 | Chen | A47B 21/0314 |
| 2018/0279770 | A1* | 10/2018 | Crowe | A47B 9/10 |
| 2018/0332957 | A1* | 11/2018 | Li | A47B 23/04 |
| 2018/0360208 | A1* | 12/2018 | Liao | A47B 13/00 |
| 2020/0298599 | A1* | 9/2020 | Tsuchiya | B41J 29/06 |

FOREIGN PATENT DOCUMENTS

| | | | | |
|---|---|---|---|---|
| TW | M526853 | U | 8/2016 | |
| WO | WO-2017045506 | A1 * | 3/2017 | A47B 21/02 |

* cited by examiner

HEIGHT-ADJUSTABLE DESK STRUCTURE

BACKGROUND OF THE INVENTION

1. Technical Field

The present invention relates to a desk structure, and in particular to a height-adjustable desk structure.

2. Description of Related Art

Please refer to FIG. 1 showing a drawing of a structure of an adjustable lifting desk disclosed by Taiwan Patent No. M526853. The adjustable lifting structure comprises a desktop 1, a base 2 and an adjustment mechanism 3. The adjustment mechanism 3 comprises two scissor stands 4 arranged opposite from each other. The head portion of the two scissor stands are assembled to the bottom surface of the desktop 1. The bottom portion of the two scissor stands are movably assembled to the base 2. The top portions of the two scissor stands 4 include an adjustment portion 5 arranged thereon respectively. Each of the adjustment portions 5 includes a handle 6 extended outwardly from one side thereof, and the handle 6 is located underneath the desktop 1. The user can operate the two handles 6 to drive the two scissor stands 4 to move between a raised position and a lowered position, thereby adjusting the height of the desktop.

However, since both of the two handles 6 are located underneath the desktop 1, during the adjustment of the height of the desktop, the user cannot see the location of the two handles 6 clearly and has to rely on his or her memory on the locations of such handles or rely on chance to reach them, or may even have to bend over to look for the handles 6. Consequently, such design is extremely inconvenient to the user during the operation in practice and may even be hazardous, such as injuries of user's fingers due to accidental touch of sharp objects underneath the desktop.

In view of the above, the inventor seeks to overcome the aforementioned drawbacks that are known to relevant operators and developers in the industry with an improvement solution.

BRIEF SUMMARY OF THE INVENTION

An objective of the present invention is to provide a height-adjustable desk structure to allow users to be able to clearly see the locations of the adjustment members on the desk, thereby enabling intuitive and easy use of the present invention and ensuring the safety.

Accordingly, to achieve the aforementioned objective, the present invention provides a height-adjustable desk structure, comprising:

a desktop having a top surface and a bottom surface opposite from the top surface;

two adjustment members arranged on the desktop, and each including an adjusting portion penetrating the top surface and provided for viewing of a user, and a driving portion connected to the adjusting portion;

two linkage sets arranged at the bottom surface of the desktop and connected to the two adjustment members respectively, and each including a rod connected to the driving portion, a rotating member driven by the rod, and a moving member; the moving member configured to operate between a released position and a locked position;

two positioning members, each arranged at one side of a respective linkage set of the two linkage sets and located at the bottom surface of the desktop, and each having a plurality of positioning recesses formed thereon for the moving members to insert therein or withdraw therefrom;

two sliding sets respectively assembled to the two positioning members, and each including a retaining seat provided for the positioning member to be slidably arranged thereon and two rollers configured to slide inside the retaining seat and attached to the positioning member;

two springs, each arranged on one side of a respective sliding set of the two sliding sets and assembled to the desktop; and two supporting stands, each arranged at one side of a respective spring of the two springs and pivotally arranged to the desktop, and each including a first pivotal swing member and a second pivotal swing member pivotally assembled to the first pivotal swing member;

wherein when the two adjustment members are actuated, the moving members move from the locked position to the released position in order to disengage from the positioning recesses, thereby allowing the first pivotal swing member and the second pivotal swing member of the two supporting stands to swing; and when the two adjustment members are released, the moving members move from the released position to the locked position in order to be inserted the positioning recesses.

Preferably, the height-adjustable desk structure further includes a base assembled to the two supporting stands; the base includes two first frame portions and two second frame portions connected to the first frame portions; and the second frame portions are configured to be attached to the supporting stands respectively, and each one of the second frame portions includes a retaining portion and a roller portion configured to slide inside the retaining portion and connected to the second pivotal swing member.

Preferably, each one of the linkage sets comprises a first spring sleeved on one end of the rod, a second spring abutted against one of the corresponding moving members and a third spring abutted against the other one of the corresponding moving members; when the two adjustment members are actuated to move the members to the released position, the first spring, the second spring and the third spring are compressed; and when the two adjustment members are released, the first spring, the second spring and the third spring restore to an original state, leading to the movement of each of the moving members from the released position to the locked position.

Preferably, the top surface is of a rectangular shape and includes a slanted area formed at an end edge thereof.

Accordingly, the present invention provides a height-adjustable desk structure, and its characteristics mainly rely in that the adjustment members are arranged to penetrate the top surface of the desktop for observation by the user, so that the user can clearly see the locations of the adjustment members. This brings easy and intuitive use, more intuitive experiences in use, and ensure the safety.

The following provides a detailed description based on the aforementioned objectives, technical effects and features of the present invention along with the accompanied drawings.

DETAILED DESCRIPTION OF THE INVENTION

Figure 1:
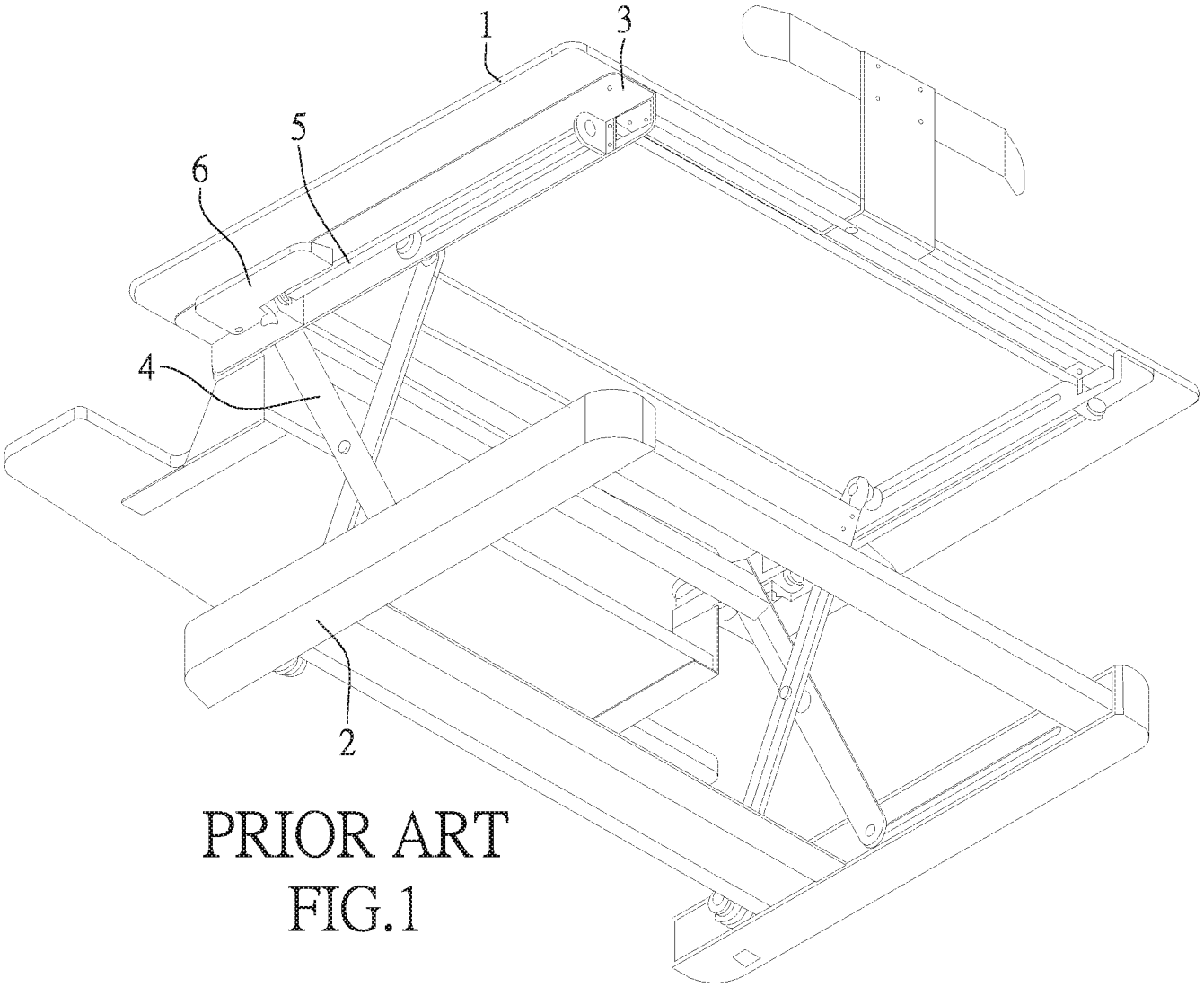
PRIOR ART FIG.1
FIG. 1 shows a drawing of an adjustable lifting desk disclosed by Taiwan Patent No. M526853.
Figure 2:
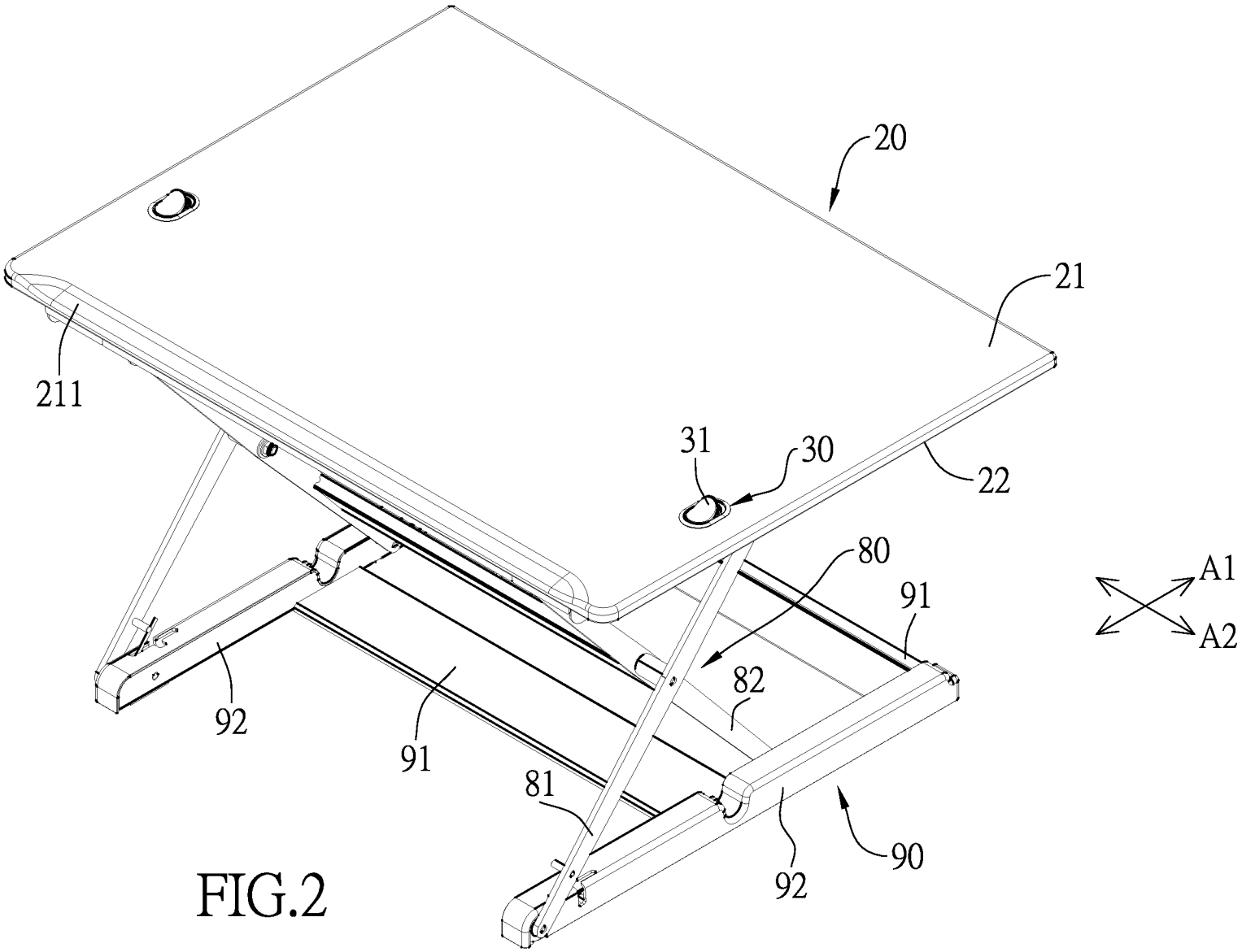
FIG. 2 is a structure drawing (1) of an embodiment of the present invention.
Figure 3:
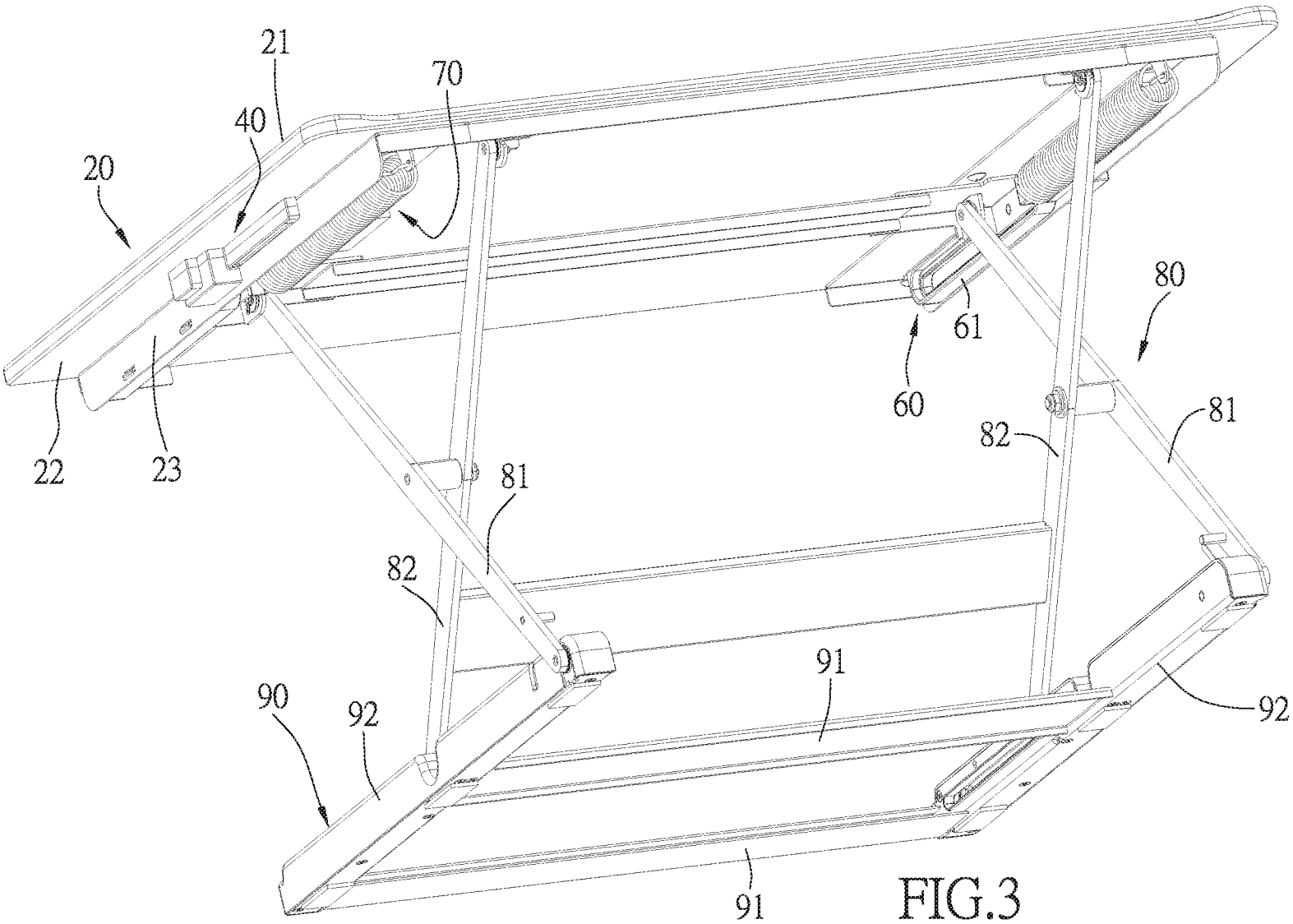
FIG. 3 is a structure drawing (2) of an embodiment of the present invention.
Figure 4:
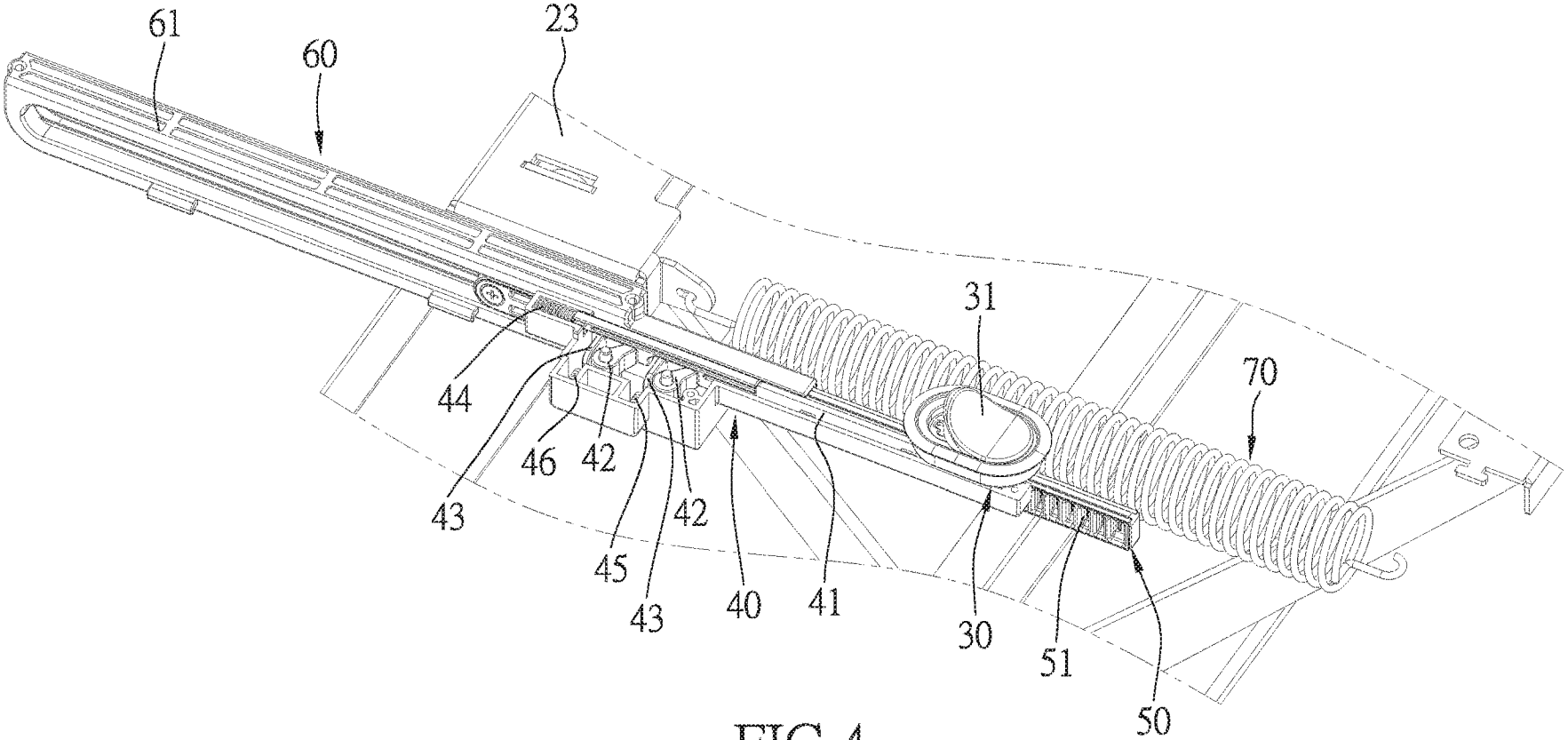
FIG. 4 is a partial structure drawing (1) of an embodiment of the present invention.
Figure 5:
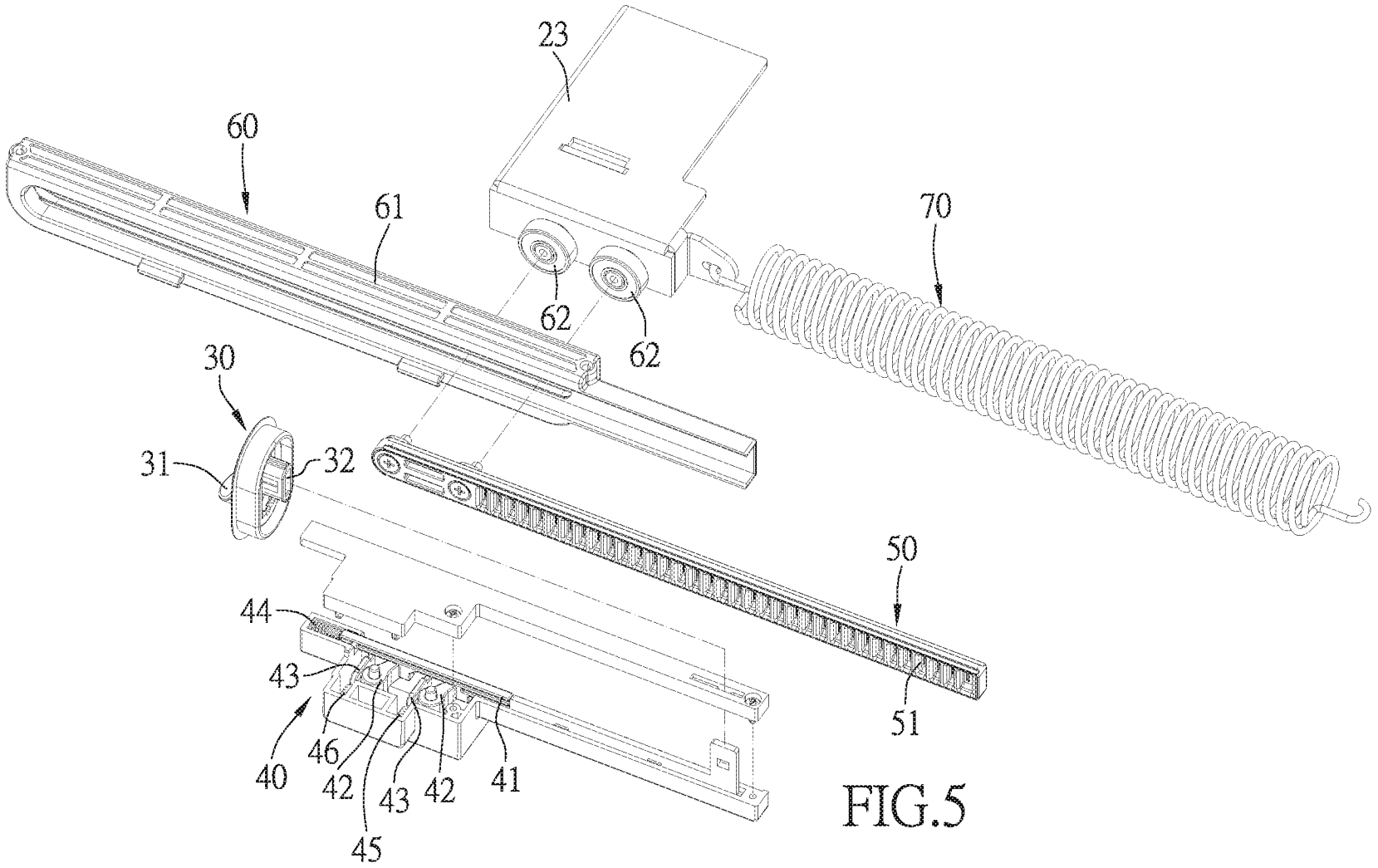
FIG. 5 is an exploded view of the embodiment shown in FIG. 4.

With regard to the aforementioned technical content, features and effects of the present invention, the following provides detailed description of preferred embodiments of the present invention along with the accompanied drawings.

As shown in FIG. 2 to FIG. 10, the present invention provides an embodiment of a height-adjustable desk structure, mainly comprising a desktop 20, two adjustment members 30, two linkage sets 40, two positioning members 50, two sliding sets 60, two springs 70, two supporting stands 80 and a base 90.

The desktop 20 is of a rectangular shape and includes a top surface 21 and a bottom surface 22 opposite from the top surface 21. In this embodiment, the bottom surface 22 of the desktop 20 is assembled to a desk rack 23, and a slanted area 211 is formed at an edge of the top surface 21. With the design of the slanted area 211, the arms of a user can rest on such area with comfort.

The two adjustment members 30 are arranged on the desktop 20, and each includes an adjusting portion 31 penetrating the top surface 21 and allowing the user to view such a portion directly, and a driving portion 32 connected to the adjusting portion 31. When the user actuates or releases the two adjustment members 30, the two adjustment members 30 are able to move along a first axial direction A1.

The two linkage sets 40 are arranged at the bottom surface 22 of the desktop 20 and are connected to the two adjustment members 30 respectively, and each includes a rod 41 connected to the driving portion 32, a rotating member 42 driven by the rod 41 to pivot, and a moving member 43 driven by the rotating member 42. The moving members 43 are able to operate between a released position P1 and a locked position P2. In this embodiment, each one of the linkage sets 40 comprises a first spring 44 sleeved on an end of the rod 41, a second spring 45 abutted against one of the moving members 43, and a third spring 46 abutted against the other one of the moving members 43. When the user actuates the two adjustment members 30 to move the moving members 43 to the released position, the first springs 44, the second springs 45 and the third springs 46 are compressed at the same time and each one of the rotating members 42 is also driven to rotate in a clockwise direction. Therefore, each one of the moving members 43 moves along a second axial direction A2, wherein the second axial direction A2 is perpendicular to the first axial direction A1. When the user releases the two adjustment members 30, the first springs 44, the second springs 45 and the third springs 46 restore to the original state, and each one of the rotating members 42 is also driven to rotate in a counterclockwise direction, thereby allowing each one of the moving members 43 to move along the second axial direction A2 to move to the locked position from the released position.

The two positioning members 50 are of an elongated shape, and each is arranged on one side of a respective linkage set of the two linkage sets 40, as well as located at the bottom surface 22 of the desktop 20 and includes a plurality of positioning recesses 51 formed thereon for the moving members 43 to insert therein or withdraw therefrom.

The two sliding sets 60 are of an elongated shape and are assembled to the two positioning members 50 respectively, and each one of the two sliding sets 60 includes a retaining seat 61 for the positioning member 50 to slide thereon and two rollers 62 configured to slide inside the retaining seat 61 and attached to the positioning member 50.

Each of the two springs 70 is arranged at one side of a respective sliding set 60 of the two sliding sets 60 and assembled to the desk rack 23 of the desktop 20. In this embodiment, the springs 70 are extended along the first axial direction A1.

Each one of the two supporting stands 80 is arranged on one side of a respective spring 70 of the two springs 70 and pivotally attached to the desk rack 23 of the desktop 20. In this embodiment, each one of the supporting stands 80 includes a first pivotal swing member 81 and a second pivotal swing member 82 pivotally assembled to the first pivotal swing member 81. The first pivotal swing member 81 and the second pivotal swing member 82 are configured to cross each other to form an X shape.

Figure 6:
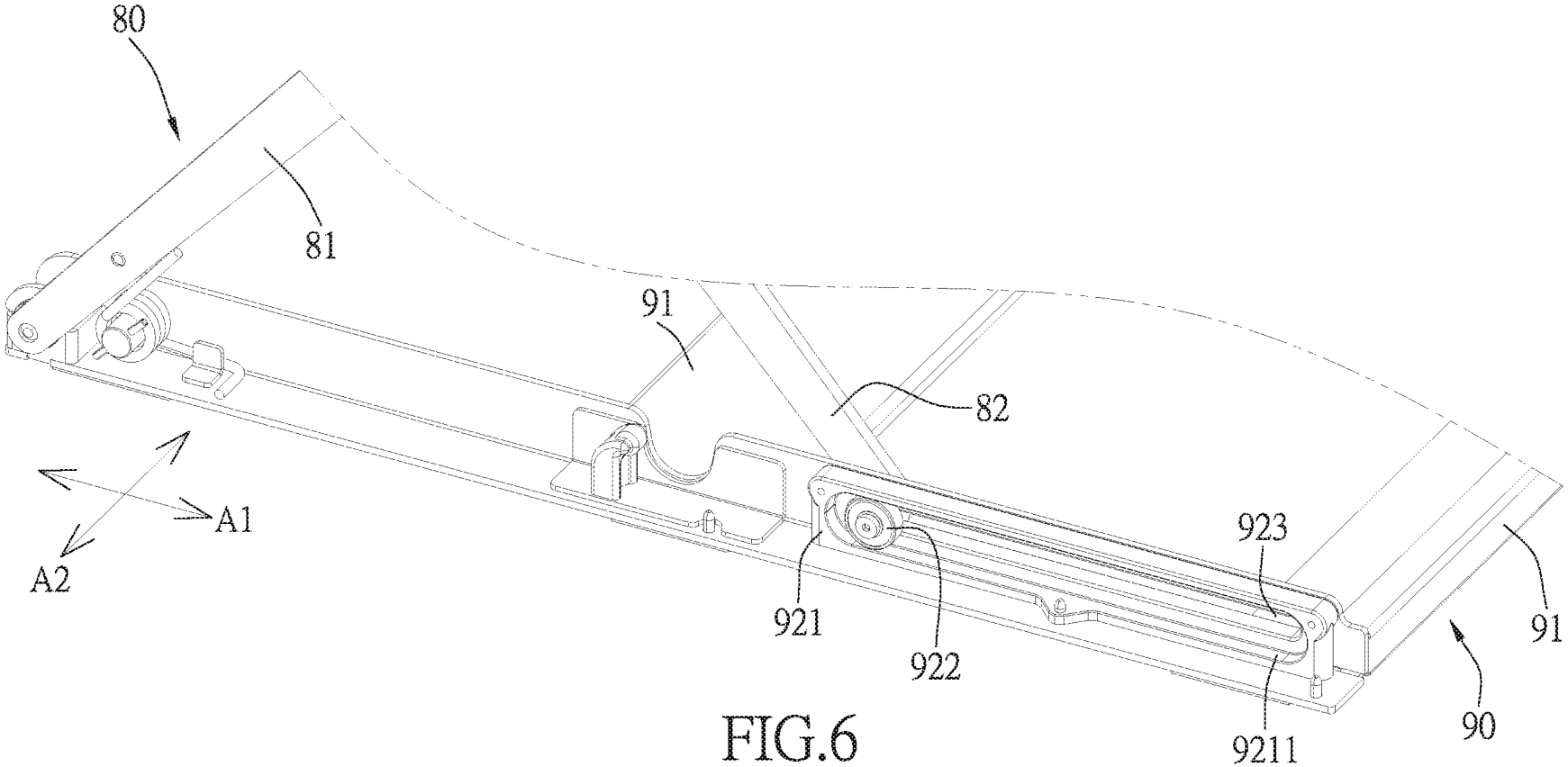
FIG. 6 is a partial structure drawing (2) of an embodiment of the present invention.
Figure 7:
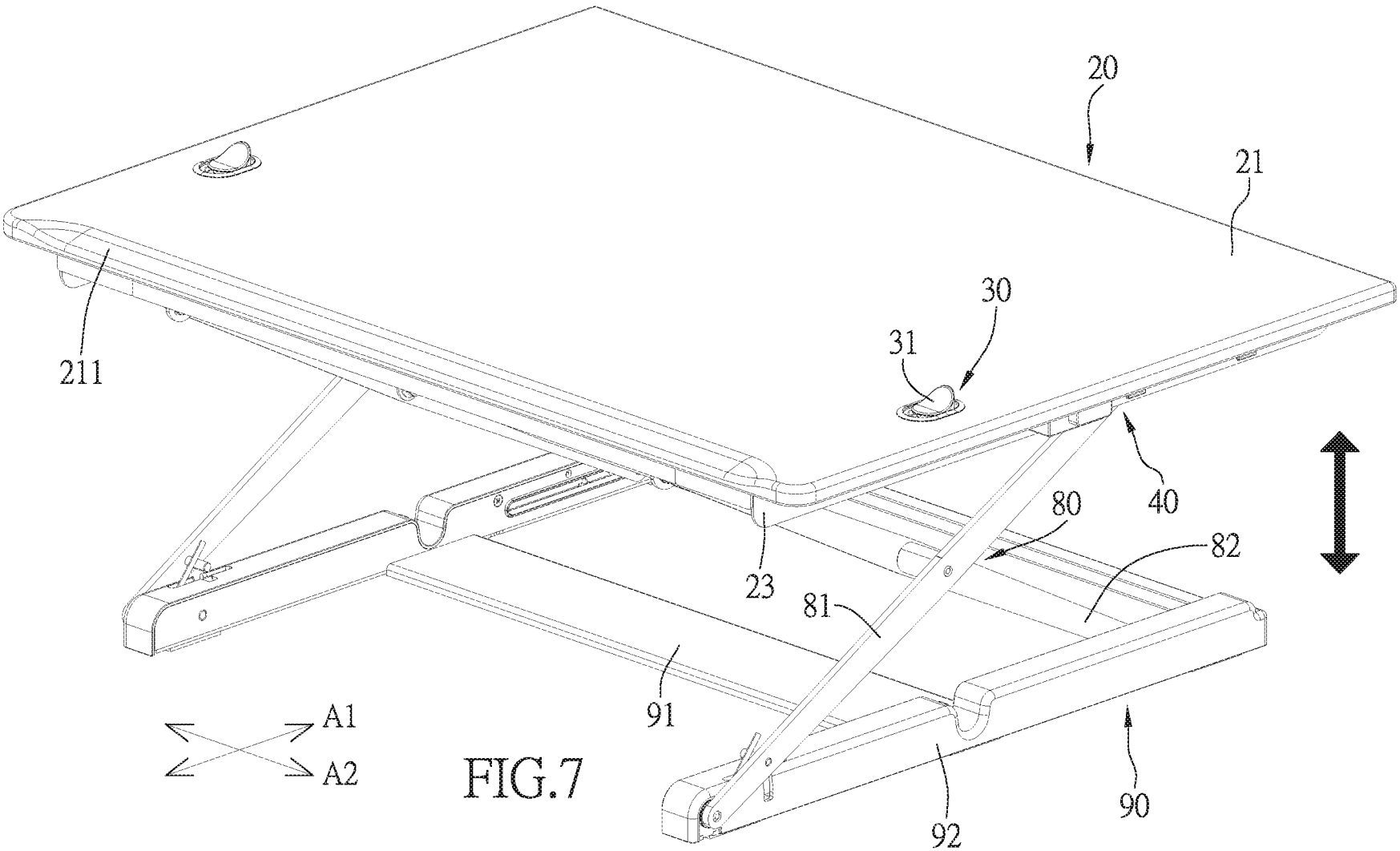
FIG. 7 is a drawing (1) of an embodiment of the present invention in use.
Figure 8:
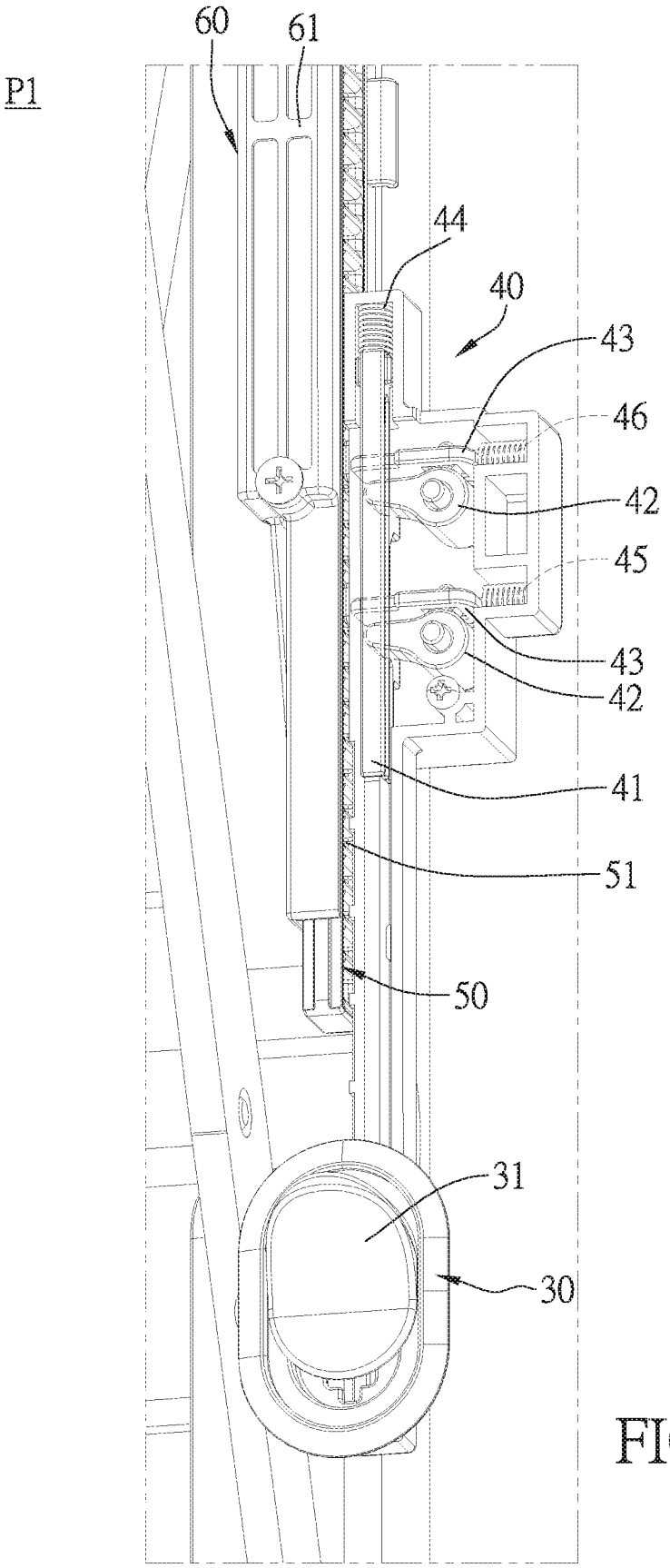
FIG. 8 is an enlarged view of the embodiment shown in FIG. 7, showing the moving member at the released position.
Figure 9:
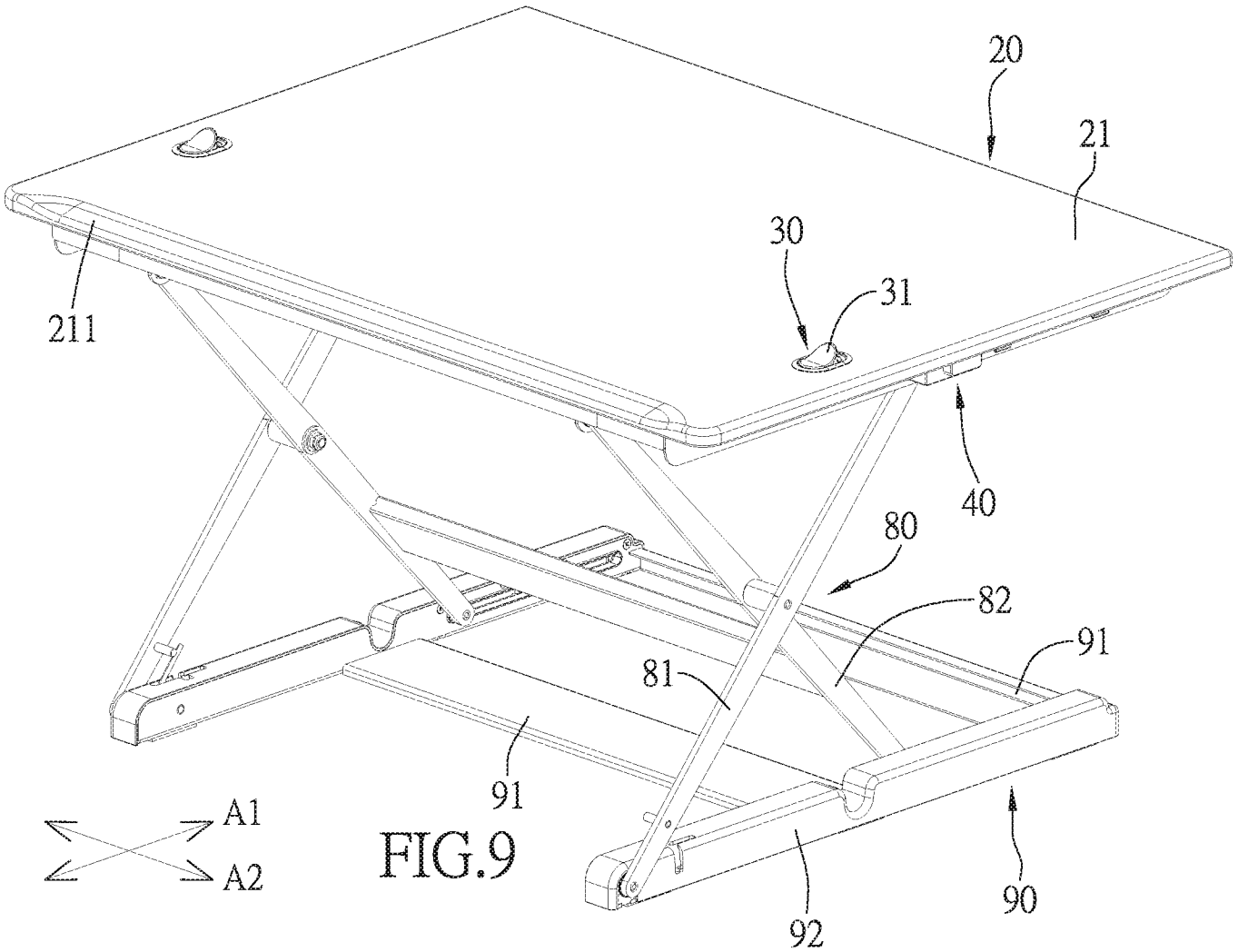
FIG. 9 is a drawing (2) of an embodiment of the present invention in use.
Figure 10:
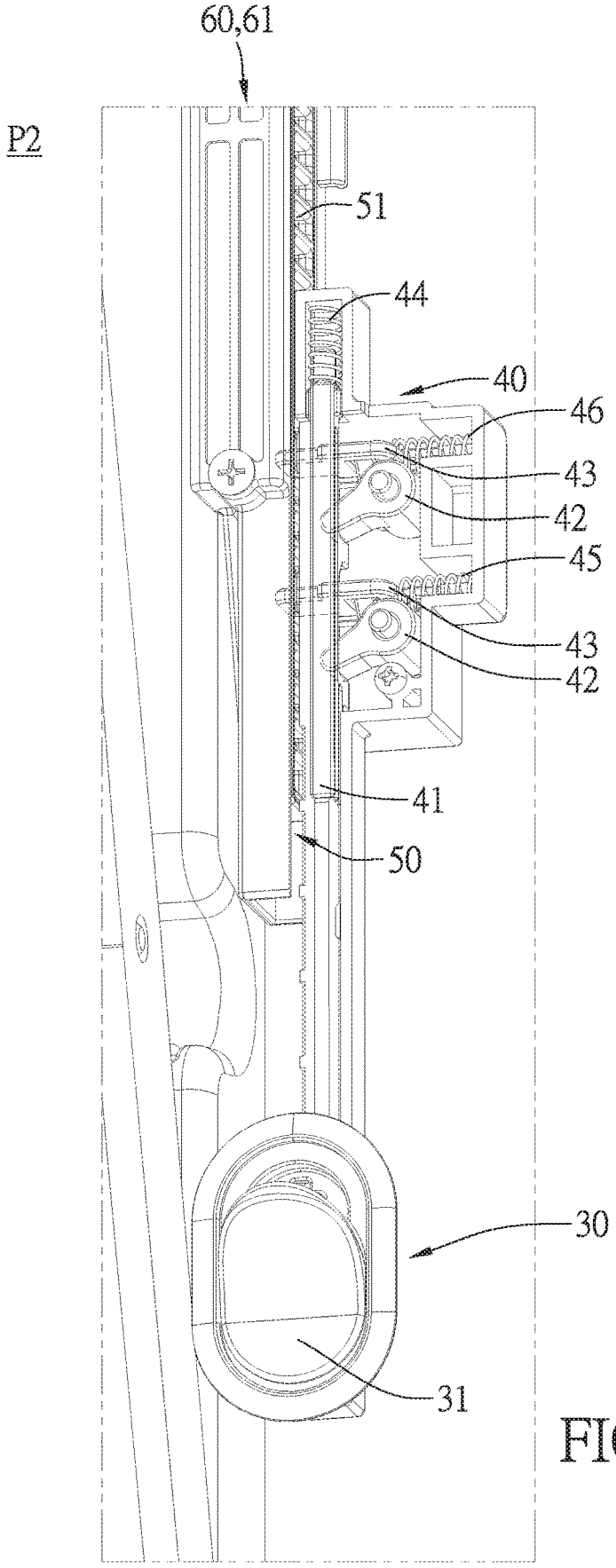
FIG. 10 is an enlarged view of the embodiment shown in FIG. 9, showing the moving member at the locked position.

The base 90 is assembled to the two supporting stands 80 and includes two first frame portions 91 arranged along the second axial direction A2 and spaced apart by a distance, and two second frame portions 92 connected to the two first frame portions 91. Each one of the second frame portions 92 includes a retaining portion 921 and a roller portion 922 configured to slide inside the retaining portion 921 and connected to the second pivotal swing member 82; wherein the roller portion 922 slides along the first axial direction A1. In addition, each one of the second frame portions 92 includes a through hole 923 formed thereon. The retaining portion 921 includes a sliding hole 9211 formed to connect with the through hole 923 and provided for the roller portion 922 to be slidably arranged thereon, as shown in FIG. 6.

Please refer to FIG. 7 to FIG. 10. When the user actuates the two adjustment members 30, the moving members 43 are able to move from the locked position P2 to the released position P1 along the second axial direction A2 in order to disengage from the positioning recesses 51, thereby allowing the first pivotal swing member 81 and the second pivotal swing member 82 of the two supporting stands 80 to swing, so that the distance between the desktop 20 and the base 90 can be adjusted to consequently adjust the height of the desktop. When the two adjustment members 30 are released, the moving members 43 are able to move from the released position P1 to the locked position P2 along the second axial direction A2. Therefore, the moving members 43 are inserted in the positioning recesses 51 to stop the first pivotal swing member 81 and the second pivotal swing member 82 of the two supporting stands 80 from swinging, so that the distance between the desktop 20 and the base 90 can be adjusted to consequently adjust the height of the desktop.

The above describes the configuration of the main structural members of the embodiment of the present invention, and please further refer to the following for the method of use and effects of the present invention.

Accordingly, the present invention provides a height-adjustable desk structure, and its main features rely in that the adjustment members 30 are arranged to penetrate the top surface 21 of the desktop 20 and to be viewed directly by the user, allowing the user to clearly see the locations of the adjustment members 30. Consequently, easy and intuitive use of the present invention and the enhanced safety may be achieved.

In view of the above, it shall be understood that the content of the above description is provided to illustrate the preferred embodiments of the present invention only such that it shall not be used to restrict the claim scope of the present invention. Accordingly, any mere modifications and equivalent structural changes made based on the disclosure of the specification and drawings of the present invention shall be considered to be within the claim scope of the present invention.

What is claimed is:

1. A height-adjustable desk structure, comprising:

a desktop having a top surface and a bottom surface opposite from the top surface;

two adjustment members arranged on the desktop, and each comprising an adjusting portion penetrating the top surface and provided for viewing of a user, and a driving portion connected to the adjusting portion;

two linkage sets arranged at the bottom surface of the desktop and respectively connected to the two adjustment members, and each comprising a rod connected to the driving portion, a rotating member driven by the rod, and a moving member; the moving member configured to operate between a released position and a locked position;

two positioning members, each arranged at one side of a respective linkage set of the two linkage sets and located at the bottom surface of the desktop, and each comprising a plurality of positioning recesses formed thereon for the moving members to insert therein or withdraw therefrom;

two sliding sets respectively assembled to the two positioning members, and each comprising a retaining seat provided for the positioning member to be slidably arranged thereon and two rollers configured to slide inside the retaining seat and attached to the positioning member;

two springs, each arranged on one side of a respective sliding set of the two sliding sets and attached to the desktop; and two supporting stands, each arranged at one side of a respective spring of the two springs and pivotally attached to the desktop, and each including a first pivotal swing member and a second pivotal swing member pivotally assembled to the first pivotal swing member;

wherein when the two adjustment members are actuated, the moving members move from the locked position to the released position in order to disengage from the positioning recesses, thereby allowing the first pivotal swing members and the second pivotal swing members of the two supporting stands to swing; when the two adjustment members are released, the moving members move from the released position to the locked position in order to be inserted in the positioning recesses, so that the first pivotal swing members and the second pivotal swing members of the two supporting stands are stopped from swinging.

2. The height-adjustable desk structure according to claim 1, wherein the height-adjustable desk structure further includes a base assembled to the two supporting stands; the base includes two first frame portions and two second frame portions connected to the first frame portions; the second frame portions are configured to attached to the supporting stands respectively, and each one of the second frame portions includes a retaining portion and a roller portion configured to slide inside the retaining portion and connected to the second pivotal swing member.

3. The height-adjustable desk structure according to claim 1, wherein each one of the linkage sets comprises a first spring sleeved on one end of the rod, a second spring abutted against one of the moving members, and a third spring abutted against the other one of the moving members; when the two adjustment members are actuated to move the members to the released position, the first springs, the second springs and the third springs are compressed; when the two adjustment members are released, the second springs and the third springs restore to an original state, each of the moving members moves from the release position to the locked position.

4. The height-adjustable desk structure according to claim 1, wherein the top surface is of a rectangular shape and includes a slanted area formed at an edge thereof.

* * * * *